US005086952A

United States Patent [19]

Kryk

[11] Patent Number: 5,086,952

[45] Date of Patent: Feb. 11, 1992

[54] DETERGENT CONTAINER

[75] Inventor: Lewis R. Kryk, Windsor, Canada

[73] Assignee: Diversey Corporation, Wyandotte, Mich.

[21] Appl. No.: 242,914

[22] Filed: Sep. 12, 1988

[51] Int. Cl.[5] ..... B67D 5/58

[52] U.S. Cl. ..... 222/189; 222/565; 222/652; 422/264; 422/278

[58] Field of Search ..... 222/565, 465.1, 189, 222/325, 652; 239/310; 206/219, 424.5; 422/264, 278, 267

[56] References Cited

U.S. PATENT DOCUMENTS

| | | | |
|---|---|---|---|
| 2,428,588 | 10/1947 | Schroeder et al. | 222/465.1 X |
| 2,645,382 | 7/1953 | Plough | 222/565 X |
| 3,215,299 | 10/1965 | Coanda et al. . | |
| 3,387,732 | 6/1968 | Jellies . | |
| 3,537,498 | 10/1970 | St. Amand . | |
| 3,581,928 | 6/1971 | St. Amand . | |
| 3,635,367 | 1/1972 | Morita . | |
| 3,901,399 | 8/1975 | McPhee . | |
| 4,301,935 | 10/1981 | Gokcen et al. . | |
| 4,569,781 | 2/1986 | Fernholz . | |
| 4,571,327 | 2/1986 | Larson et al. | 222/652 X |
| 4,687,121 | 8/1987 | Copeland | 222/189 X |
| 4,690,305 | 9/1987 | Copeland | 222/189 X |
| 4,790,981 | 12/1988 | Mayer | 222/189 X |
| 4,938,375 | 7/1990 | Fantacone | 222/189 X |

*Primary Examiner*—Donald T. Hajec
*Assistant Examiner*—Gregory L. Huson
*Attorney, Agent, or Firm*—Weintraub, DuRoss & Brady

[57] ABSTRACT

This new detergent delivery system involves the formation of a detergent solution from a solid detergent material. The system comprises a container for holding the detergent pellets, and a lid. The container includes a hollow body portion, a base portion, and a passageway. The container has a handle which is pivotally attached to the hollow body portion. The base portion of the container has a recess molded therein, and tabs for retentively engaging the handle in a nested position when the handle is not in use. The lid retentively and disengageably fits securely with a coupling means of the passageway. The lid includes means for retentively and disengageably fitting securely within the passageway of the container. An integral grid is formed within the lid, the grid having a plurality of apertures forming a pattern therein. The grid is divided into four quadrants, and the pattern on each quadrant is similar.

37 Claims, 2 Drawing Sheets

DETERGENT CONTAINER

BACKGROUND OF THE INVENTION

1. Field of the Invention

The present invention relates to a detergent container and a lid affixed thereto, the container and lid being integral to a detergent delivery system. The detergent container has a hinged handle which enables the container to be readily grasped when the container and its contents are disposed in an inverted position. The lid includes an intergal grid formed therein by a plurality of apertures, the lid traversing the opening of the container and assuring that detergent solution is dispensed therefrom in a predictable and controlled manner.

2. Background Act

U.S. Pat. No. 4,459,781 is illustrative of the manner in which containers have been utilized in detergent applications. A liquid detergent composition is cast into a mold where it is allowed to solidify. A mold surrounds the solid cast detergent on all surfaces except the top. The solid detergent and the mold are inverted and placed into a closed dispenser where water is sprayed upon the solid detergent. The liquid aqueous detergent flows out of the dispenser as the liquid is formed in the dispenser.

Plastic containers have commonly used in medical applications for storing and dispensing liquids (see for example U.S. Pat. Nos. 4,301,935, 3,901,399, 3,635,367, 3,581,928, 3,537,498, 3,387,732, and 3,215,299). Typically, these containers iclude an integral hanger or handle hingedly attached to the base of the container, and a recess in the base of the container for the storing handle when the container is set in an upright position. The integrally attached hanger is used to suspend the container and its contents in an inverted position for dispensing the contents of the container.

Although these medical-type containers have potential utility in dispensing detergent solutions, the container needs to be redesigned for this new application. Since, the detergents may be highly caustic, causing skin irritations, burns, rashes, and being irritable to the mucous membrane, considerable care must be taken in their handling and storing. Dispensing the detergent from the storage container into a dispensing container or directly into a washing machine or the like can provide major handling problems for attendant personnel. Also, the container must be modified so that the detergent is not dispensed en masse when the container is inverted.

SUMMARY OF THE INVENTION

This new detergent delivery system enables the detergent to be safely and conveniently stored in an upright position, and enables the detergent to be dispensed from the container in a predictable and controlled manner when the container is inverted and placed into a dispenser.

This new detergent delivery system includes a container for holding the detergent, and a lid. The container has a hollow body portion, a base portion, and a passageway. The container has a handle which is pivotally attached to the base portion. The base portion of the container has a recess molded therein, and integral tabs for retentively engaging the handle in a nested position when the handle is not in use. The tabs are disposed within the recess. The handle enables the container to be readily removed from the dispenser after the cleaning operation has been completed.

The lid includes means for retentively and disengagably fitting securely to the container. An integral grid is formed within the lid, the grid having a plurality of apertures forming a pattern therein. The grid is divided into four quadrants, and the pattern on each quadrant is similar. The larger apertures are dispersed evenly about each quadrant. The smaller apertures form clusters which surround each of the larger apertures.

The detergent delivery system also minimizes handling problems associated with these materials in that the storage container is used to depense the detergent solution. The system includes a container cover, which is removed the lid when the container is inverted and inserted into the dispenser. The lid is preferably inserted onto the container under the cover at the time when the container is filled with the detergent material.

The detergent is generally stored within the container in solid form; such as briquettes, tablets, beads, or flakes; although for use with the subject invention, pellets are preferred. A unique lid exposes the detergent to a solvent which is sprayed into the container when the container is inverted and inserted into a dispenser. The solvent spray dissolves the detergent material in a predictable and controllable rate, and the detergent solution is dispensed from the container. U.S. Pat. application Ser. No. 215,985, entitled "Detergent Pellet Composition" provides a more detailed explanation of the chemistry of the detergent compositions, the disclosure of which is hereby incorporated by reference.

For a more complete understanding of the detergent delivery system of the present invention, reference is made to the following detailed description and accompanying drawings in which the presently preferred embodiment of the invention is illustrated by way of example. It is expressly understood, however, that the drawings are for purposes of illustration and description only, and are not intended as a definition of the limits of the invention. Throughout the following description and drawings, identical reference numbers refer to the same component throughout the several views.

DETAILED DESCRIPTION OF THE INVENTION

Figure 1:
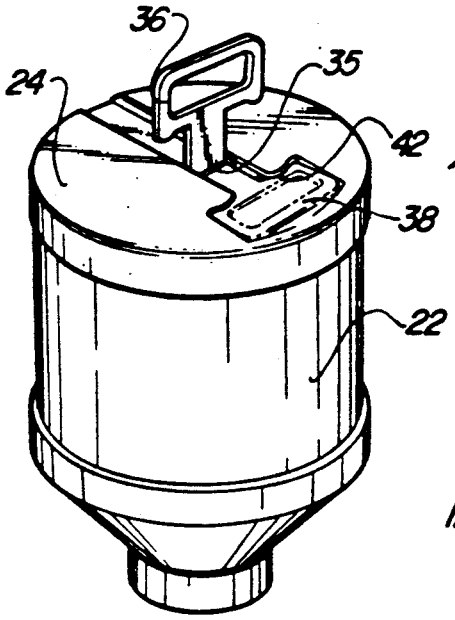
FIG. 1 is a perspective view of the preferred embodiment of the container and the handle of the present invention.
Figure 2:
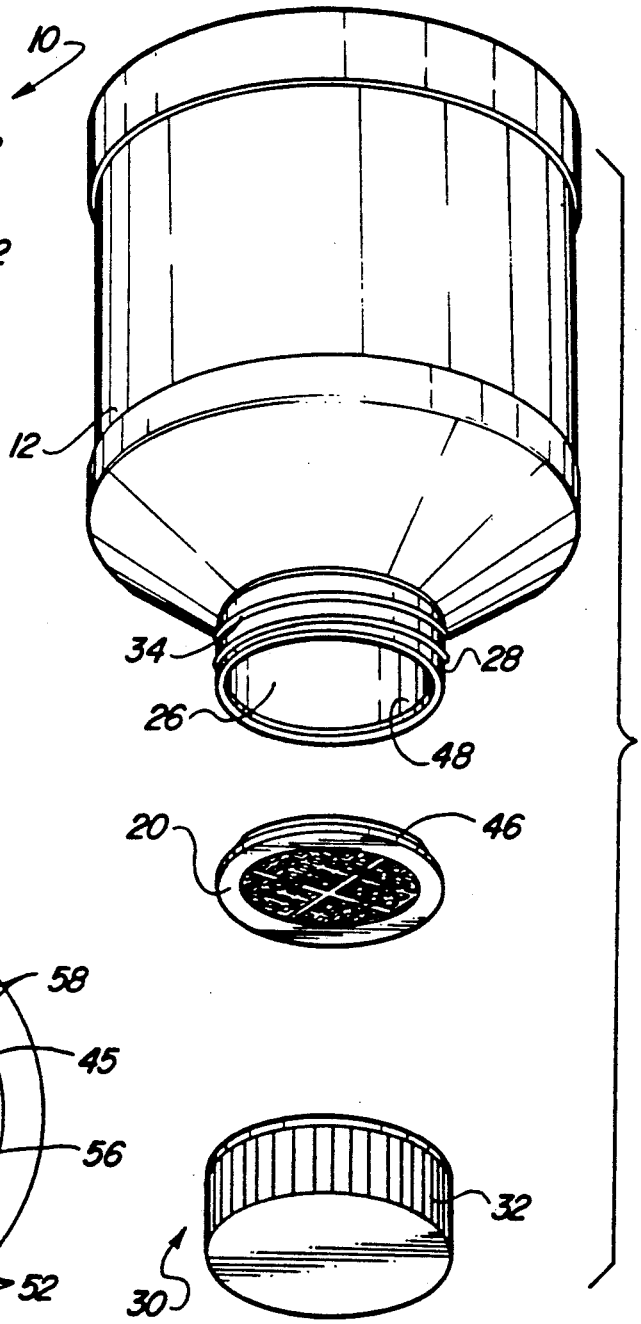
FIG. 2 is an assembly view of the detergent delivery system of the present invention, including the container as depicted in FIG. 1, the cover and the lid.

Referring now the drawings, FIGS. 1 and 2 depict a perspective view of the preferred embodiment of the present invention of the container 12 which is an integral part of the detergent delivery system 10. The detergent delivery system 10 involves the formation of a detergent solution from a detergent in solid form, such as pellets, briquettes, beads, flakes, bricks, or the like.

The detergent delivery system 10 as seen in FIG. 2, comprises a container 12 for holding the detergent material (not shown), and a lid 20. The container 10 includes a hollow body portion 22, a base portion 24, and a passageway 26. The container 10 preferably includes a tapered neck portion 28 which is an integral part of the hollow body portion 22. The neck portion 28 terminates into the passageway 26. The neck portion 28 is disposed between the hollow body portion 22 and the passageway 26. The cross-sectional area of the neck portion 28 is less than the cross-sectional area of the body portion 22. The lid 20 is press fitted into the passageway 26 and is tightly seated therein.

The container 12 also preferably includes means 30 for covering and sealing the passageway 26, so that the container 12 and its contents may be safely stored. The sealing means preferably is a cover 32 which is secured to the container 12 by external threads about the lip portion 34 of the container 12. The inside surface of the cover 32 is similary threaded so as to cooperate with the threaded lip 34 to securely seal the container 12. Of course, other modes of removably securing the cover to the container may be used.

The container 12 has a handle 36 which is pivotally attached as at 35 via a linging hinge or the like to the base portion 24, and is capable of supporting the container 12 and its contents. The handle 36 is retracted from a recess 38 in the base portion 24 when the container 12 is to be removed from the detergent dispenser. Preferably, the handle 36 is an integrally molded part of the container 12. The recess 38 of the base portion is also molded therein, and tabs 42 which are disposed within the recess 38 are useful for retentively engaging the handle 36 in a nested position. The tabs 42 do not interfere with the container 12 when it is in an upright position on a flat surface. When the container 12 is in the inverted position as shown in FIG. 1, the handle 36 is dislodged from the tabs 42 in the recess 38 and rotated about 90° so that the container 12 can be readily grasped.

Figure 3:
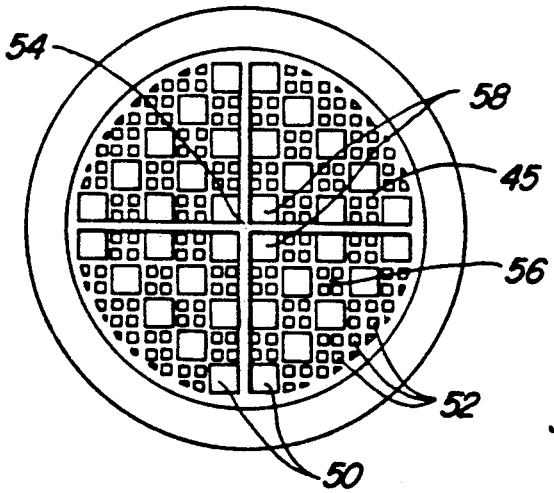
FIG. 3 depicts the preferred embodiment of the grid pattern of the lid of the present invention as depicted in FIG. 2.

FIG. 3 depicts the preferred embodiment of the grid pattern 45 of the lid 20 of the detergent delivery system 10. The lid 20 retentively and disengagably fits securely into a coupling means 46 within the container 12. Preferably, the coupling means 46 is an internal flange 48 disposed inside the lip portion 34 of the container 12. The integral grid 45 is formed within the lid 20, the grid 45 having a plurlaity of larger apertures 50 and smaller apertures 52 forming a pattern therein. The size of the apertures is smaller than the detergent material 16, so that the solid detergent 16 will not pass through the apertures when the container 12 is disposed in an inverted position.

The grid 45 is divided into four quadrants 54, and the pattern on each quadrant 54 is similar, and preferably, the pattern on each quadrant 54 is identical. The larger apertures 50 are dispersed evenly about each quadrant 54. The smaller apertures 52 form clusters 56 which surround each of the larger apertures 50. The plurality of apertures 50 and 52 within each quadrant 54 form a pattern. Preferably, all of the apertures 50 and 52 have the same general shape, which is rectangular, and in the embodiment shown, essentially square. Preferably, each cluster 56 of smaller apertures 52 contains four apertures, and the perimeter of each smaller aperture 52 is about one-fourth of the perimeter of each larger aperture 50. Each quadrant 54 has a generally checkerboard configuration in that the larger apertures 50 are alternated with the clusters 56 of smaller apertures 52. A larger aperture 50 is disposed at the center of the grid 45 at the corner of each quadrant 54.

A first cluster 58 of the larger apertures are disposed proximate to the center of the grid 45. The first cluster 58 of larger apertures are surrounded by a first cluster 56 of the smaller apertures. The first cluster of the smaller apertures 56 are most distant from the center of the grid 45 than the cluster 58 of larger apertures. Successive clusters of larger apertures and successive clusters of smaller apertures are thereafter alternated. Each successive cluster is more distant from the center of the grid 45 than is the preceding cluster.

The container 12 is preferably formed from a rigid plastic material. Although the container 12 can be made from any of a variety of plastic materials, polyethylene is preferred. The container 12 is molded, and the handle 36 is preferably molded as an integral part of the container 12. The container 12 is preferably cylindrical in shape.

The container 12 of the present invention becomes a detergent delivery system 10 when the container 12 is filled with detergent material, the passageway 26 is covered by the lid 20, the container 12 is inverted and positioned into a dispenser 68, and inserted into a dishwashing machine or the like (not shown). The container 12 enables the detergent to be safely and conveniently stored in an upright position, and enables the detergent to be delivered from the container 12 in a predictable and controlled manner when the container 12 is disposed in an inverted position in the dispenser 68.

Figure 4:
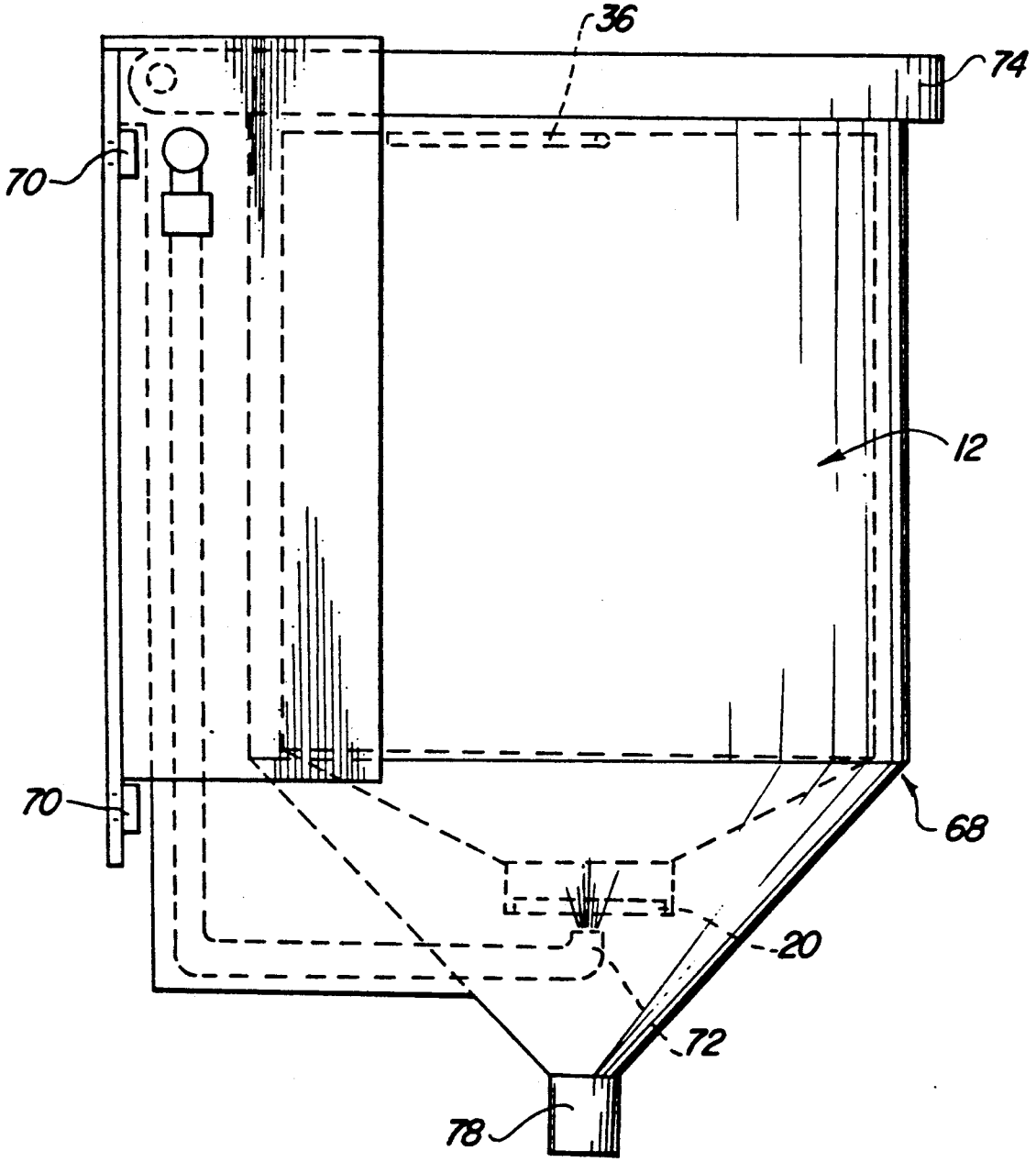
FIG. 4 depicts the container of the present invention housed within a dispensing apparatus.

FIG. 4 depicts the container 12 of the present invention disposed within the dispenser 68, which is similar to other dispensers generally known to those skilled in the art. The dispenser 68 is necessary to insure that the detergent solution is delivered from the container 12 in a predictable and controlled manner when the container 12 is inverted therein. The dispenser 68 is secured by fastener means 70 to the inside of an industrial washer (not shown). The portion of the dispenser adjacent to the inverted lid 20 is in fluid communication with a water supply 72.

The apertures 50 and 52 in the lid 20 allow a solvent spray 60, such as water, to be sprayed into the passageway 26 of the container 12. When the water supply is activated, the water is sprayed into the container 12, dissolving some of the detergent material therein, which flows out of the container 12, through the lid 20, and through the piping 78 that is in fluid communication with the wash tank. The top of the dispenser 68 has a spring-biased hinged lid 74 through which the container 12 is inserted and subsequently removed.

The container 12 loaded with the solid detergent, preferably in pellet form, is inserted into the dispenser 68. The grid pattern 45 in the lid is particularly appropriate for use with pelletized detergent composition, because the larger apertures 50 permit the passage therethrough of a high volume of solvent, while the smaller apertures 52 act to retain small pieces of undissolved detergent from being dispensed from the container 12.

While the detergent delivery system 10 of the present invention has been described in conjunction with a specific embodiment, it is evident that many alternatives, modifications, and variations will be apparent to those skilled in the art in light of the disclosure herein. It is intended that all such alternatives, modifications, and variations are included herein that fall within the spirit and scope of the appended claims.

I claim:

1. A detergent delivery system whereby a detergent solution is formed from dissolving a detergent material with a liquid, the system comprising:

a container for holding the detergent material, the container having a hollow body portion, a passageway, and a base portion, the base portion having rotatable means for grasping the container when the container is disposed in an inverted position; and a lid fitting retentively and securely within the passageway of the hollow body portion, the lid having an integral grid, the grid being divided into quadrants, each quadrant of the grid having a plurality of first apertures and a plurality of second apertures, the size of the second apertures being different from the size of the first apertures, the first apertures and the second apertures cooperating to form a pattern in each quadrant, the pattern in each quadrant being substantially identical to the pattern in each of the other quadrants, the first apertures and the second apertures enabling a detergent solvent solution to pass therethrough and dissolve the detergent material into a detergent solution.

2. The detergent delivery system of claim 1, wherein the detergent material is in the form of pellets, and the size of some of the pellets is larger than some of the apertures.

3. The detergent delivery system of claim 1, wherein the grasping means is a handle, and the means for grasping is pivotally attached to the base portion.

4. The detergent delivery system of claim 1, wherein the base portion has a recess molded therein.

5. The detergent delivery system of claim 4, wherein tabs are disposed in the base portion of the container, the tabs retentively engaging the means for grasping in a nested position when the handle is not in use, the tabs being disposed within the recess.

6. A container comprising:

a hollow body portion, a base portion, and a passageway, and the container having means for grasping the container in an inverted position, the passageway being opposed to the base portion, the passageway having a coupling means, and the container having a lid which retentively and disengagably fits securely with the coupling means of the passageway, the lid having a grid formed thereon, the grid having a plurality of first and second apertures forming a pattern therein, wherein a first cluster of the first apertures are disposed proximate to the center of the grid, the first cluster of first apertures being surrounded by a first cluster of the second apertures, the first cluster of the second apertures being more distant from the center of the grid than the cluster of first apertures, and thereafter successive clusters of first apertures and successive clusters of second apertures, each successive cluster of apertures alternating between first apertures and second apertures, and each successive cluster being more distant from the center of the grid than the preceding cluster.

7. The container of claim 6, further comprising a tapered neck portion which is an integral part of the hollow body portion, the neck portion terminating into the passageway, the neck portion being disposed between the hollow body portion and the passageway, and the cross-sectional area of the neck portion being less than the cross-sectional are of the body portion.

8. The container of claim 6, wherein the grasping means is a handle, and the handle being pivotally attached to the hollow body portion.

9. The container of claim 6, wherein the base portion has a recess molded therein.

10. The container of claim 6, wherein the base portion of the container has tabs for retentively engaging the handle in a nested position when not in use, the tabs being disposed within the recess.

11. The container of claim 6, further comprising means for covering and sealing the passageway.

12. The container of claim 11, further comprising a cover which may be secured to the sealing means.

13. The container of claim 6, wherein the first apertures are larger than the second apertures.

14. The container of claim 6, wherein the first apertures are symmetrically dispersed about the grid.

15. The container of claim 6, wherein the grid is divided into quadrants, the plurality of apertures within each grid forming a pattern, and wherein each quadrant has a generally checkerboard configuration in that the first apertures are alternated between the clusters of second apertures.

16. The container of claim 15, wherein each quadrant grid pattern is identical.

17. A container comprising: a hollow body portion, a base portion, and a passageway, a handle being pivotally attached to the base portion, a recess being molded into the base portion, tabs being disposed within the recess for retentively engaging the handle in a nested position when the handle is not in use, the handle capable of supporting the container when the container is suspended in an inverted position, the passageway being opposed to the base portion, the passageway having a coupling means, and the container having a lid which retentively and disengagably fits securely with the coupling means of the passageway, the lid having a grid formed thereon, the grid having a plurality of first and second apertures forming a pattern therein, the first apertures being larger than the second apertures, the apertures being symmetrically disposed about the grid.

18. The container of claim 17, wherein a first cluster of the first apertures are disposed proximate to the center of the grid, the first cluster of firsts apertures being surrounded by a first cluster of the second apertures, the first cluster of the second apertures being more distant from the center of the grid than the cluster of first apertures, and thereafter successive clusters of first apertures and successive clusters of second apertures, each succussive cluster of apertures alternating between the first apertures and second apertures, and each successive cluster being more distant from the center of the grid than the preceding cluster.

19. The container of claim 18, further comprising means for covering and sealing the passageway.

20. The container of claim 19, wherein the sealing means comprises a cover.

21. The container of claim 19, wherein the grid is divided into quadrants, the plurality of apertures within each grid forming a pattern, and wherein each quadrant has a generally checkerboard configuration in that the first apertures are alternated between the clusters of second apertures.

22. The container of claim 21, wherein each quadrant grid pattern is identical.

23. A container lid which comprises: means for retentively and disengagably fitting securely within a passageway in a container; and an integral grid formed on the lid, the grid having a plurality of first and second apertures forming a pattern therein, a first cluster of the first apertures are disposed proximate to the center of the grid, the first cluster of first apertures being surrounded by a first cluster of the second apertures, the first cluster of the second apertures being more distant from the center of the grid than the cluster of first apertures, and thereafter successive clusters of first apertures being alternated with successive clusters of second apertures, and each successive cluster being more distant from the center of the grid than the preceding cluster.

24. The container lid of claim 23, wherein the first apertures are larger than the second apertures.

25. The container lid of claim 23, wherein the first apertures and the second apertures have the same general shape.

26. The container lid of cliam 23, wherein the first apertures are evenly dispersed throughout the pattern.

27. The container lid of claim 25, wherein the shape of the apertures is essentially square.

28. The container lid of claim 23, wherein the grid is divided into quadrants, the plurality of apertures within each grid forming a pattern, and wherein each quadrant has a generally checkerboard configuration in that the clusters of first apertures are alternated with the clusters of second apertures.

29. The container lid of claim 28, wherein each quadrant grid pattern is identical.

30. The container lid of claim 28, wherein each of the quadrants contains a first aperture nearest the center of the grid, the first apertures being larger than the second apertures.

31. The container lid of claim 23, wherein the perimeter of each second aperture is about one-fourth of the perimeter of each first aperture.

32. A container lid which comprises: means for retentively and disengagably fitting securely within a passageway of the container; and an integral grid formed on the lid, the grid having a plurality of first and second apertures forming a pattern therein, the first apertures being larger than the second apertures, the grid having four quadrants, the pattern on each of the quadrants being similar, the first apertures being dispersed evenly about each quadrant, the second apertures forming clusters which surround each of the first apertures, each quadrant having a generally checkerboard configuration in that the clusters of first apertures are alternated with the clusters of second apertures, wherein a first aperture is disposed proximate to the center of the quadrant.

33. The container lid of claim 32, wherein the first cluster of first apertures are surrounded by a first cluster of the second apertures, the first cluster of the second apertures are more distant from the center of the grid than the cluster of first apertures, and thereafter the grid having successive clusters of first apertures and successive clusters of second apertures, each successive cluster of apertures alternating between first apertures and second apertures, and each successive cluster being more distant from the center of the grid than the preceding cluster.

34. The container lid of claim 32, wherein the first aperture and the second apertures have the same general shape.

35. The container lid of claim 34, wherein the shape of the apertures is essentially square.

36. The container lid of claim 32, wherein each quadrant grid pattern is identical.

37. The container lid of claim 32, wherein the perimeter of each second aperture is about one-fourth of the perimeter of each first aperture.

* * * * *